US009662769B2

(12) United States Patent
Sue

(10) Patent No.: US 9,662,769 B2
(45) Date of Patent: May 30, 2017

(54) MULTI-LAYERED PDC CUTTERS

(75) Inventor: Jiinjen Albert Sue, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 582 days.

(21) Appl. No.: 14/126,745

(22) PCT Filed: Jun. 8, 2012

(86) PCT No.: PCT/US2012/041659

§ 371 (c)(1),
(2), (4) Date: Dec. 16, 2013

(87) PCT Pub. No.: WO2012/173893

PCT Pub. Date: Dec. 20, 2012

(65) Prior Publication Data

US 2014/0116789 A1 May 1, 2014

Related U.S. Application Data

(60) Provisional application No. 61/497,858, filed on Jun. 16, 2011.

(51) Int. Cl.

| | |
|---|---|
| ***E21B 10/567*** | (2006.01) |
| ***B24D 18/00*** | (2006.01) |
| ***C22C 26/00*** | (2006.01) |
| *B22F 5/00* | (2006.01) |

(52) U.S. Cl.

CPC ..... *B24D 18/0009* (2013.01); *C22C 26/00* (2013.01); *E21B 10/567* (2013.01); *E21B 10/5676* (2013.01); *B22F 2005/001* (2013.01); *B22F 2998/00* (2013.01)

(58) Field of Classification Search

CPC ..... E21B 10/567; E21B 10/5676

See application file for complete search history.

(56) References Cited

U.S. PATENT DOCUMENTS 5,266,236 A * 11/1993 Bovenkerk ..... B01J 3/062 252/503
5,488,232 A * 1/1996 Glass ..... H01L 21/02425 257/613
2003/0131787 A1 7/2003 Linares
2004/0095051 A1* 5/2004 Nishibayashi ..... H01J 1/3044 313/309
2006/0191723 A1 8/2006 Keshavan (Continued)

FOREIGN PATENT DOCUMENTS

EP 0531085 A2 3/1993

OTHER PUBLICATIONS

Liang, Qi et al., Mechanical Properties of Boron Doped Diamond Films Prepared by MPCVD, Mat. Res. Soc. Symp. Proc. vol. 79, 2004 Material Research Society, 6 pages.

(Continued)

*Primary Examiner* — Giovanna C Wright

(74) *Attorney, Agent, or Firm* — Conley Rose, P.C.

(57) ABSTRACT

A cutter element for a drill bit, comprising: a substrate having a longitudinal axis; a first layer of polycrystalline diamond coupled to the substrate; and a second layer of polycrystalline diamond coupled to the first layer at a first coherent boundary; where the first layer is axially positioned between the substrate and the second layer.

22 Claims, 9 Drawing Sheets

(56) References Cited

U.S. PATENT DOCUMENTS

| | | | | |
|---|---|---|---|---|
| 2007/0017437 | A1 | 1/2007 | Genis et al. | |
| 2010/0200305 | A1* | 8/2010 | Griffin | B22F 7/06 175/434 |
| 2012/0152622 | A1* | 6/2012 | Sue | E21B 10/567 175/428 |

OTHER PUBLICATIONS

Paszkowica, W., et al., Lattice Parameter of Polycrystalline Diamond in the Low-Temperature Range, ACTA Physica Polonica A, vol. 117 (2010), pp. 323-327.

Saotome, Takao, et al., Thermal expansion of a boron-doped diamond single crystal at low temperature, J. Phys: Condens. Matter 10 (1998), p. 1267-1272.

Initial Publication with International Search Report for PCT/US2012/041659 dated Dec. 20, 2012 (33 pages).

U.K. Examination Report Dated Mar. 22, 2016, for U.K. Application No. 1322218.7 (4 p.).

U.K. Examination Report dated Oct. 12, 2016, for U.K. Application No. 1322218.7 (3 p.).

* cited by examiner

MULTI-LAYERED PDC CUTTERS

CROSS REFERENCE TO RELATED APPLICATIONS

This application is a 35 U.S.C. §371 national stage application of PCT/US2012/041659 filed Jun. 8, 2012, which claims the benefit of U.S. Provisional Application No. 61/497,858 filed Jun. 16, 2011, both of which are incorporated herein by reference in their entirety for all purposes.

STATEMENT REGARDING FEDERALLY SPONSORED RESEARCH OR DEVELOPMENT

Not applicable.

BACKGROUND

Field of the Invention

The invention relates generally to earth-boring drill bits used to drill a borehole for the ultimate recovery of oil, gas, or minerals. More particularly, the invention relates to an improved cutting structure for such bits. Still more particularly, the present invention relates to polycrystalline diamond compact cutter elements with improved toughness and thermal stability.

Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed. Two predominant types of drill bits are roller cone bits and fixed cutter bits, also known as rotary drag bits. A common fixed cutter bit has a plurality of blades angularly spaced about the bit face. The blades generally project radially outward along the bit body and form flow channels there between. Cutter elements are typically mounted on the blades.

The cutter elements disposed on a fixed cutter bit are typically formed of extremely hard materials and include a layer of polycrystalline diamond ("PD") material. In the typical fixed cutter bit, each cutter element comprises an elongate and generally cylindrical support member which is received and secured in a pocket formed in the surface of one of the several blades. In addition, each cutter element typically has a hard cutting layer of polycrystalline diamond or other super-abrasive material such as cubic boron nitride, thermally stable diamond, chemically modified or doped diamond, polycrystalline cubic boron nitride, or ultra-hard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer that contains polycrystalline diamond (PDC refers to Polycrystalline Diamond Compact).

The cost of drilling a borehole for recovery of hydrocarbons is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is desirable to employ drill bits which will drill faster and longer, and which are usable over a wider range of formation hardness. The length of time that a drill bit may be employed before it must be changed depends upon a variety of factors. These factors include the bit's rate of penetration ("ROP"), as well as its durability or ability to maintain a high or acceptable ROP. In turn, ROP and durability are dependent upon the cutter elements' abrasion resistance, toughness and ability to resist thermal degradation.

Manufacturing polycrystalline diamond requires high pressure and high temperature. Initially, pressure is increased causing the diamond crystals to be pushed against each other with increasing force. These particles move relative to each other and often fragment, increasing the powder apparent density. A coarse powder displays a higher degree of crushing than a finer one, as the average number of contact points per unit volume is much higher for fine powders, and therefore fine powders display a lower contact stress and lower probability for fragmentation.

Secondly, during manufacturing, when the compacted powder is under full pressure, the temperature is raised. The diamond powder is typically packed against a WC—Co substrate, the origin of the catalyst metal (Co) that induces sintering. When the cobalt reaches its melting point, it is forced into the open porosities left within the layer of compacted powder. Sintering takes place through carbon dissolution and precipitation and reduction of internal energy. Densification is determined by the pressure and by the contact area relative to the cross-sectional area of the particles. The reaction speed is proportional to the temperature and to the average effective pressure, which is the actual contact pressure between particles. The sintering process is therefore faster if both the contact pressure and the temperature are increased. Smaller grain size and better packing result in lower contact pressure; therefore sintering PDC of very small particle size requires higher pressures and temperatures.

The smaller the size of the diamond crystals sintered together, the higher the wear abrasion resistance, but the lower the impact strength of the resulting PDC. With larger diamond particle sizes a lower abrasion resistance is observed, but an increased toughness is achieved. Diamond compacts have limited heat resistance and experience high thermal wear. At atmospheric pressure, a diamond's surface turns to graphite at 900° C. or higher. In a vacuum or in inert gas, diamond does not graphitize easily, even at 1,400° C. However during use, conventional PDC cutters experience a decline in cutting performance around 750° C., which the cutting edge can easily reach due to frictional heating in hard, abrasive rock.

Flash temperatures which are extremely high localized temperatures at the microscopic level, can be much higher, exceeding the melting temperature of cobalt (1,495° C.). The presence of cobalt is believed to be the reason that PDC converts to graphite at a lower temperature than simple diamond.

When temperatures increase, graphitization of the diamond in the presence of cobalt becomes a dominant effect. Diamond wear is then due to an allotropic transformation into graphite or amorphous carbon under the influence of localized frictional heating. This transformation is accelerated in the presence of cobalt through a combination of mechanical and chemical effects. For example, the shear resistance of the cobalt drops rapidly, and the grains are not strongly held, leading to additional damage to the surface. It is also known that the real area of contact depends on the velocity with which plastic strains are propagated in the metal binder. The shearing occurs so rapidly that full plastic yielding under the normal load is not possible.

In addition, there is a significant difference between the thermal expansion coefficients of cobalt and diamond. During heating, cobalt expands at a higher rate than diamond. The amount of thermal stress in the diamond table increases, and the structure breaks down. The cobalt between the diamond crystals expands and breaks the diamond-to-diamond bonds.

The PDC cutting element therefore becomes extremely hot during drilling, however it is known that the temperature at a distance of a few microns from the contact point is about 95% of the (absolute) temperature at the point of contact. Since the temperature decreases very rapidly with increasing distance from the shearing zone (about 400 K/mm), the cutting tip behaves like a thin film of low shear strength, supported by a hard substrate. Therefore, improving the thermal stability of the cutting edge of the PDC cutting element would significantly improve drilling performance.

PDC cutters can be categorized by their abrasion resistance, impact resistance and thermal stability, and it is difficult to get all three properties maximized in one cutter variant (a cutter that is highly abrasion resistant is characterized by fine diamond particle/grain size, and a cutter that is highly impact resistant is characterized by a coarse particle/grain size).

Accordingly, there remains a need in the art for a fixed cutter bit with a cutting structure capable of enhancing bit ROP, and bit durability. As such, embodiments disclosed herein address the requirement for improved thermal stability in PDC cutting elements, and further embodiments provide PDC cutting elements with characteristics to impart high abrasive resistance and high impact strength as compared to certain conventional cutters known in the art.

BRIEF SUMMARY OF THE DISCLOSED EMBODIMENTS

These and other needs in the art are addressed in one embodiment of the present invention by a cutter element for a drill bit, comprising: a substrate having a longitudinal axis; a first layer of polycrystalline diamond coupled to the substrate; and a second layer of polycrystalline diamond coupled to the first layer at a first coherent boundary; wherein the first layer is axially positioned between the substrate and the second layer. In some embodiments the cutter element further comprising a third layer of polycrystalline diamond attached to the second layer at a second coherent boundary; wherein the second layer is axially positioned between the first layer and the third layer.

In some embodiments of the cutter element, the first layer has a first lattice constant; the second layer has a second lattice constant; whereby the second lattice constant is different from the first lattice constant. In some further embodiments of the cutter element, the third layer has a third lattice constant, wherein the third lattice constant is different from the second lattice constant. In other embodiments of the cutter element, the difference between the first and the second lattice constant is less that 10%, and in some further embodiments the difference between the second and the third lattice constant is less that 10%.

In embodiments of the cutter element, the first layer has a first particle size; the second layer has a second particle size; whereby the second particle size is different from the first particle size. In some further embodiments, the third layer has a third particle size; whereby the third particle size is different from the second particle size.

In some other embodiments of the cutter element, at least one said layer is doped with a dopant selected from the group consisting of Al, B, N, Ti, P, and Zr. In some further embodiments, the layer is doped in an amount of about 0.01 atomic percent to about 10 atomic percent of said dopant, in still further embodiments the layer is doped with B. and in some embodiments B is in an amount of less than about 0.5 atomic percent.

One embodiment is drawn to a method of applying polycrystalline diamond layers on a substrate, comprising: loading a container with a first volume of polycrystalline diamond material with a first lattice constant; loading the container with at a second volume of polycrystalline diamond material with a second lattice constant, wherein said second lattice constant is different from said first lattice constant; loading a volume of a substrate material and sintering each said volume of material by applying high temperature and high pressure; and forming a first coherent boundary between said first volume and said second volume.

Some embodiments further comprise: loading said container with a third volume of polycrystalline diamond material with a third lattice constant, wherein said third lattice constant is different to said second lattice constant; and forming a second coherent boundary between said second volume and said third volume. In some embodiments, loading is by chemical vapor deposition and in some further embodiments loading is by solid state liquid diffusion. In embodiments of the method, high temperature is a temperature greater than about 1,200K, and in some further embodiments high pressure is a pressure greater than about 7 Gpa.

Other embodiments are drawn to a drill bit for drilling a borehole in earthen formations, the bit comprising: a plurality of cutter elements mounted on the bit, wherein said cutter elements comprise: a substrate having a longitudinal axis; a first layer of polycrystalline diamond coupled to the substrate; a second layer of polycrystalline diamond coupled to said first layer at a first coherent boundary; wherein the first layer is axially positioned between the substrate and the second layer. In some further embodiments of the drill bit, the cutter elements further comprise a third layer of polycrystalline diamond coupled to the second layer at a second coherent boundary; wherein the second layer is axially positioned between the first layer and the third layer.

Thus, embodiments described herein comprise a combination of features and advantages intended to address various shortcomings associated with certain prior drill bits and PDC cutting elements, and methods of using the same. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiments of the invention, reference will now be made to the accompanying drawings, wherein.

DETAILED DESCRIPTION OF THE DISCLOSED EMBODIMENTS

Figure 1:
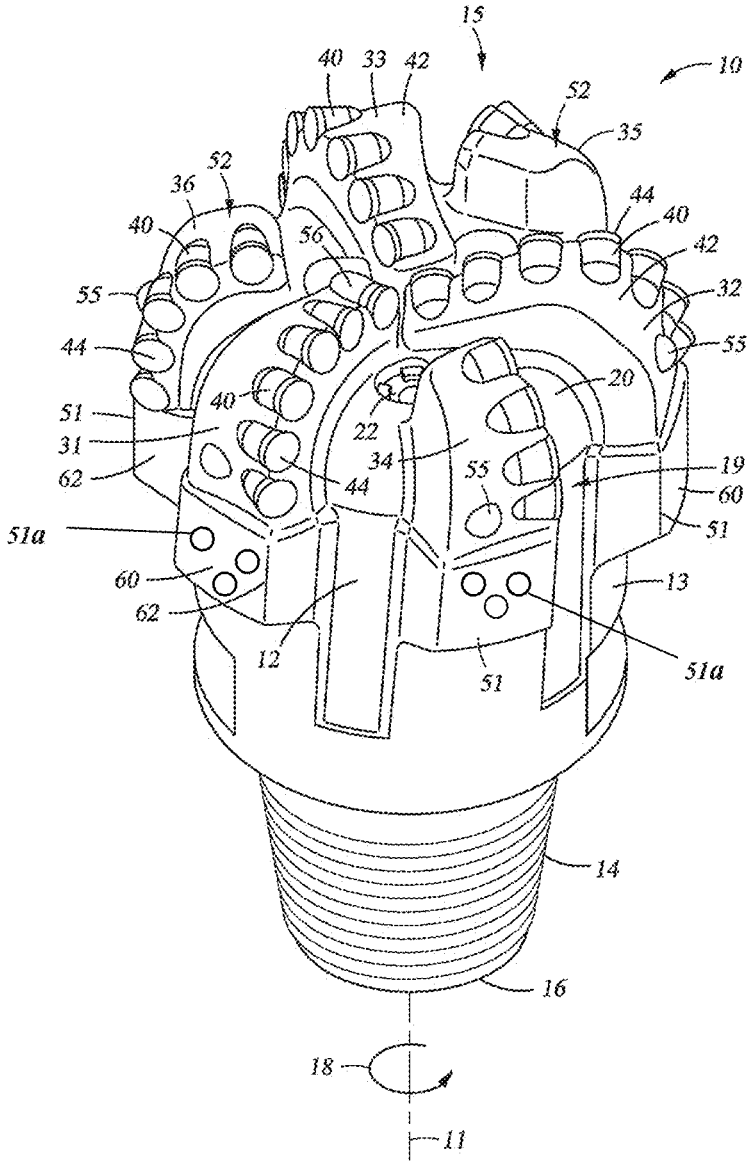
FIG. 1 is a perspective view of an embodiment of a bit made in accordance with principles described herein.

The following discussion is directed to various exemplary embodiments of the invention. However, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and that the scope of this disclosure, including the claims, is not limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may be omitted in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection via other intermediate devices and connections. As used herein, the term "about," when used in conjunction with a percentage or other numerical amount, means plus or minus 10% of that percentage or other numerical amount. For example, the term "about 80%," would encompass 80% plus or minus 8%.

Figure 2:
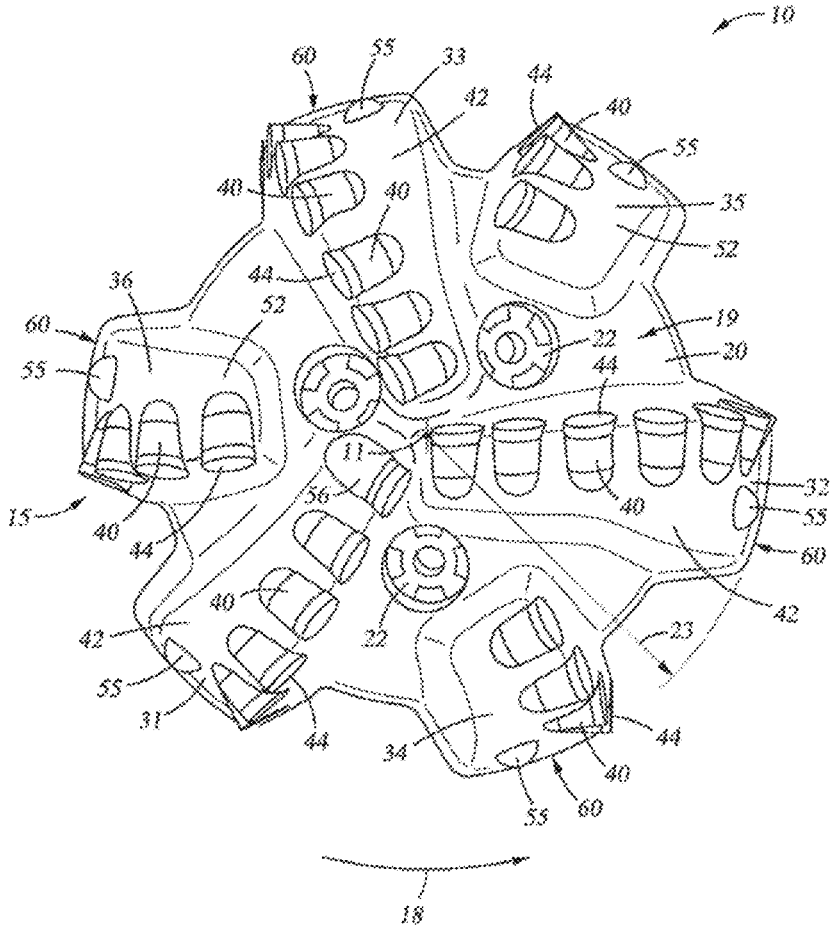
FIG. 2 is a top view of the bit shown in FIG. 1.

Referring to FIGS. 1 and 2, exemplary drill bit 10 is a fixed cutter PDC bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that faces the formation and is generally opposite pin end 16. Bit 10 further includes a central axis 11 about which bit 10 rotates in the cutting direction represented by arrow 18. As used herein, the terms "axial" and "axially" generally mean along or parallel to a given axis (e.g., bit axis 11), while the terms "radial" and "radially" generally mean perpendicular to the axis. For instance, an axial distance refers to a distance measured along or parallel to a given axis, and a radial distance refers to a distance measured perpendicular to the axis.

Body 12 may be formed in a conventional manner using powdered metal tungsten carbide particles in a binder material to form a hard metal cast matrix. Alternatively, the body can be machined from a metal block, such as steel, rather than being formed from a matrix.

Figure 3:
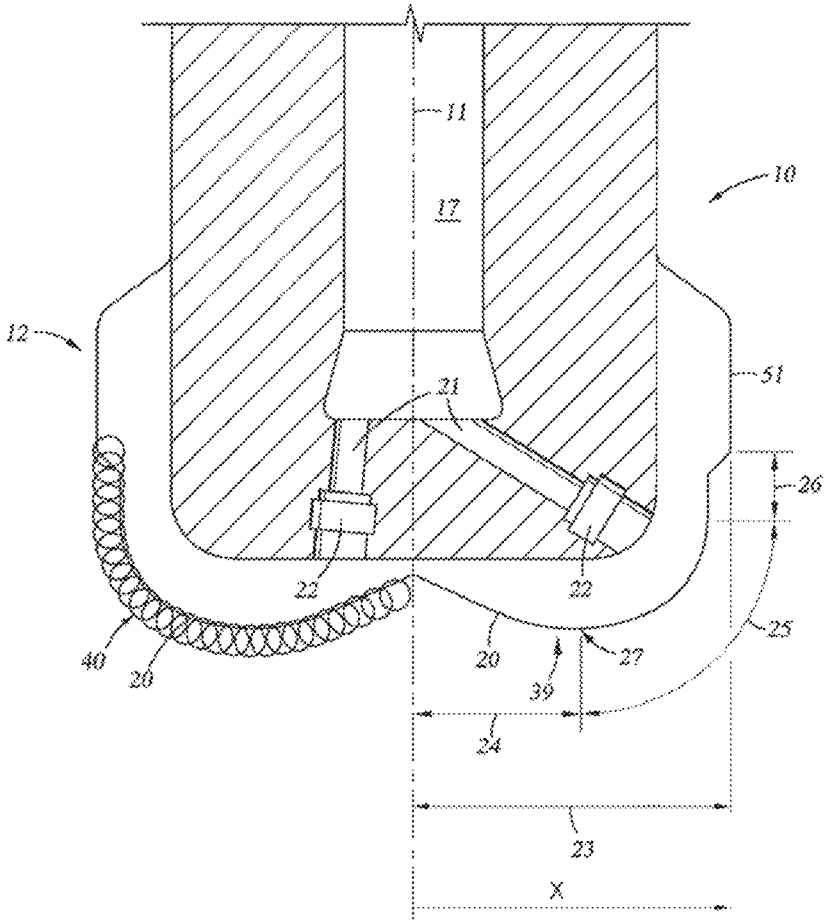
FIG. 3 is a partial cross-sectional view of the bit shown in FIG. 1 with the blades and the cutting faces of the cutter elements rotated into a single composite profile.

As best seen in FIG. 3, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around cutting structure 15 to flush away formation cuttings during drilling and to remove heat from bit 10.

Referring again to FIGS. 1 and 2, cutting structure 15 is provided on face 20 of bit 10 and includes a plurality of blades which extend from bit face 20. In the embodiment illustrated in FIGS. 1 and 2, cutting structure 15 includes six blades 31, 32, 33, 34, 35, and 36. In this embodiment, the blades are integrally formed as part of, and extend from, bit body 12 and bit face 20. The blades extend generally radially along bit face 20 and then axially along a portion of the periphery of bit 10. In particular, blades 31, 32, 33 extend radially from proximal central axis 11 toward the periphery of bit 10. Blades 34, 35, 36 are not positioned proximal bit axis 11, but rather, extend radially along bit face 20 from a location that is distal bit axis 11 toward the periphery of bit 10. Blades 31, 32, 33 and blades 34, 35, 36 are separated by drilling fluid flow courses 19.

Referring still to FIGS. 1 and 2, each blade, 31, 32, 33 includes a cutter-supporting surface 42 for mounting a plurality of cutter elements, and blade 34, 35, and 36 includes a cutter-supporting surface 52 for mounting a plurality of cutter elements. A plurality of forward-facing cutter elements 40, each having a primary cutting face 44, are mounted to cutter-supporting surfaces 42, 52 of blades 31, 32, 33 and blades 34, 35, 36, respectively. In particular, cutter elements 40 are arranged adjacent to one another in a radially extending row proximal the leading edge of blade 31, 32, 33 34, 35, and 36. Also mounted to cutter-supporting surfaces 42, 52 are protrusions 55 that trail behind certain cutter elements 40.

Referring still to FIGS. 1 and 2, bit 10 further includes gage pads 51 of substantially equal axial length measured generally parallel to bit axis 11. Gage pads 51 are disposed about the circumference of bit 10 at angularly spaced locations. Specifically, gage pads 51 intersect and extend from each blade 31-36. In this embodiment, gage pads 51 are integrally formed as part of the bit body 12.

Gage-facing surface 60 of gage pads 51 abut the sidewall of the borehole during drilling. The pads can help maintain the size of the borehole by a rubbing action when cutter elements 40 wear slightly under gage. Gage pads 51 also help stabilize bit 10 against vibration. In certain embodiments, gage pads 51 include flush-mounted or protruding cutter elements 51*a* embedded in gage pads to resist pad wear and assist in reaming the side wall. Therefore, as used herein, the term "cutter element" is used to include at least the above-described forward-facing cutter elements 40, blade protrusions 55, and flush or protruding elements 51*a* embedded in the gage pads, all of which may be made in accordance with the principles described herein.

Referring now to FIGS. 1, 2, 4*a*, and 4*b*, each cutter element 40 comprises an elongated and generally cylindrical support member or substrate which is received and secured in a pocket formed in the surface of the blade to which it is fixed. In general, each cutter element may have any suitable size and geometry.

Figure 4A:
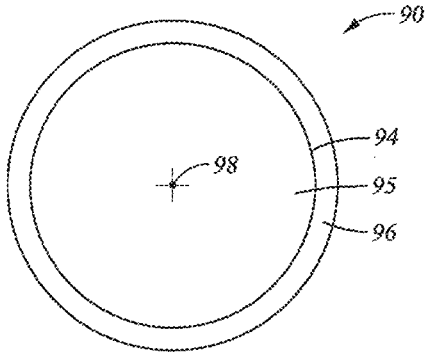
FIGS. 4*a* and 4*b* are end and side views, respectively, of an exemplary PDC cutter element made in accordance with principles described herein.
Figure 4B:
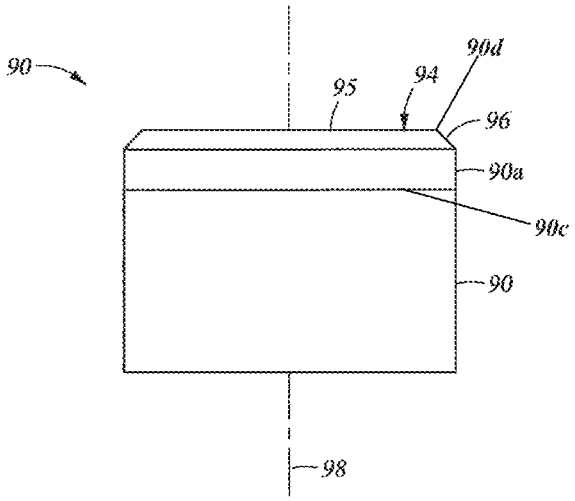

Referring to FIGS. 4*a* and 4*b*, a cutter element 40 having a cutting face 94 is shown. In general, cutter element 40 includes a PDC table 90*a* forming cutting face 94 and supported by a carbide substrate 90*b*. The interface 90*c* between PDC table 90*a* and substrate 90*b* may be planar or non-planar. Cutting face 94 is to be oriented on a bit facing generally in the direction of bit rotation. The central portion 95 of cutting face 94 is planar in this embodiment, although concave, convex, or ridged surfaces may be employed. The cutting edge 90*d* may extend about the entire periphery of table 90*a*, or along only a periphery portion to be located adjacent the formation to be cut.

Embodiments herein are further drawn to a cutter element for a drill bit, comprising: a substrate having a longitudinal axis; a first layer of polycrystalline diamond attached to the substrate; a second layer of polycrystalline diamond attached to the first layer at a first coherent boundary; wherein the first layer is axially positioned between the substrate and the second layer. In some embodiments, the cutter element further comprises a third layer of polycrystalline diamond attached to the second layer at a second coherent boundary; wherein the second layer is axially positioned between the first layer and the third layer.

Figure 5:
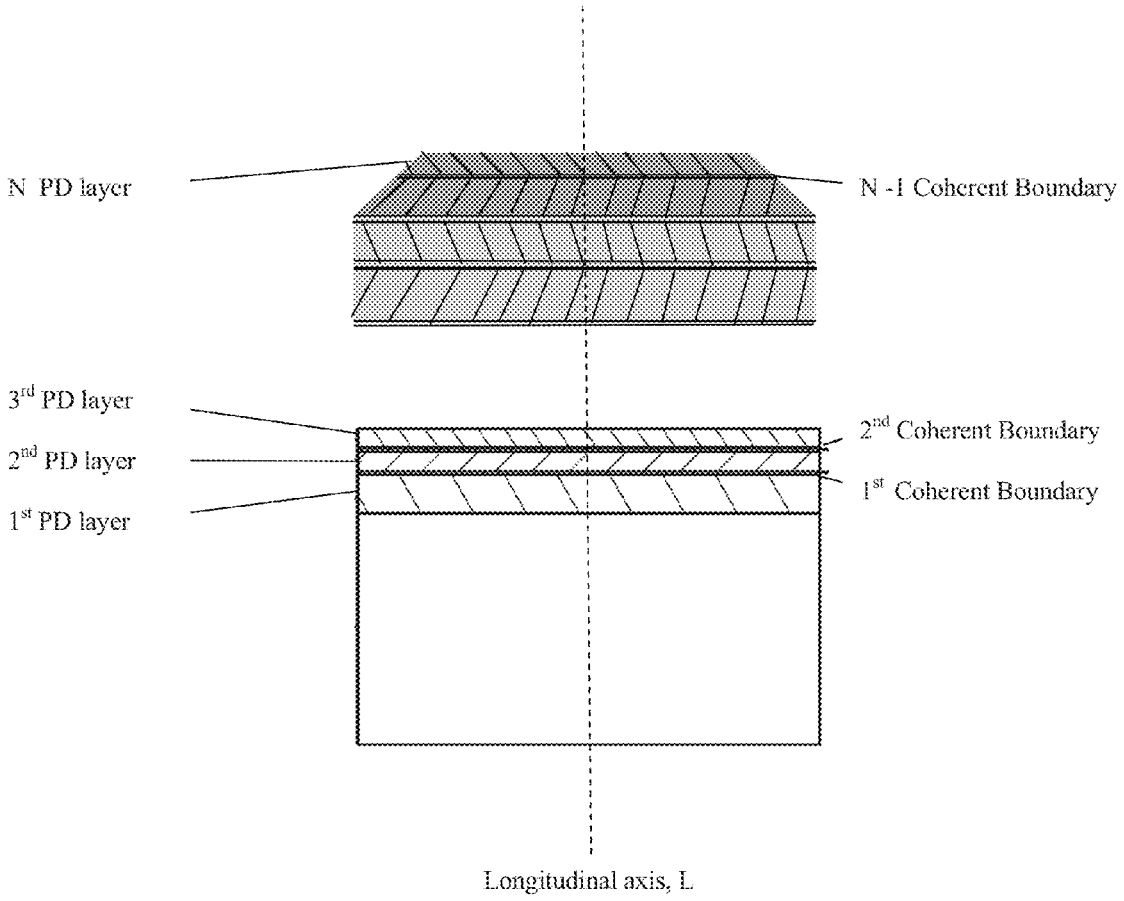
FIG. 5 depicts a cross-sectional view of the PDC cutting element of FIGS. 4*a*, and 4*b* showing a first, second and third PD layer with a first and a second coherent boundary made in accordance with principles described herein.

Referring to FIGS. 4*a*, 4*b*, and 5, the substrate in some embodiments is a cemented carbide, typically tungsten carbide, either in the form of WC and/or $W_2C$. Tungsten carbides comprise spherical cast $WC/W_2C$, cast and crushed $WC/W_2C$, and macro-crystalline WC. For hardness properties, the spherical cast $WC/W_2C$ has greater hardness than cast and crushed $WC/W_2C$, which in turn has greater hardness than macro-crystalline WC. For toughness properties, the Spherical Cast $WC/W_2C$ has greater toughness than Macro-crystalline WC, which in turn has greater toughness than cast and crushed $WC/W_2C$.

In some embodiments, the cemented carbide is a metal matrix composite where tungsten carbide particles are the aggregate and a metal binder material comprising Co, Ni, Fe, Cr, B and alloys thereof, serve as the matrix. During sintering, the binder material, such as cobalt, becomes the liquid phase and WC grains (with a higher melting point) remain in the solid phase. As a result of this process, cobalt embeds or cements the WC grains and thereby creates the metal matrix composite with its distinct material properties. The naturally ductile cobalt metal serves to offset the characteristic brittle behavior of the tungsten carbide ceramic, thus raising its toughness and durability. Properties of the substrate can be changed significantly by modifying the tungsten carbide grain size, cobalt content (e.g. alloy carbides) and carbon content. The substrate's longitudinal axis "L" is shown in FIG. 5.

Figure 6A:
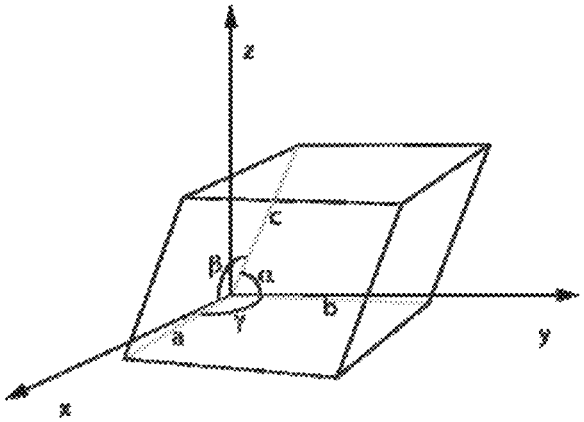
FIG. 6*a* depicts the lattice constants of the diamond crystal unit cell.

Referring to the PD of the structures depicted in FIGS. 4*a*, 4*b*, and 5, micronized diamond powder used in manufacturing of PDC cutter elements is typically fabricated from synthetic diamond powders produced by a high temperature/high pressure process, whereby polycrystalline diamond is available with a variety of particle size distributions. In some embodiments, polycrystalline diamond may also be chemically modified or doped to selectively modify the properties of the resultant PD layer. The chemical modification of PD results in a change in the unit cell dimensions of the diamond, changing the lattice constants of the diamond crystals unit cell, in comparison to pure diamond. The lattice constant refers to the constant distance between unit cells in a crystal lattice. Lattices in three dimensions generally have three lattice constants, referred to as a, b, and c (FIG. 6*a*). However, in the case of cubic crystal structures, all of the constants are equal ($a=b=c$, $\alpha=\beta=\gamma$) and reference only to constant a. is necessary. For example the lattice constant for cubic carbon diamond is a=3.5667 Å at 300 K.

Lattice constants can be determined using techniques such as X-ray diffraction or by atom force microscopy. Lattice constant matching is important for the growth of thin layers of materials on other materials. In some embodiments of the cutter element, the first layer has a first lattice constant; the second layer has a second lattice constant, whereby the second lattice constant is different than the first lattice constant. In some embodiments, the cutter element further comprises a third layer, the third layer has a third lattice constant, wherein the third lattice constant is different from the second lattice constant. Such measured lattice constants for polycrystalline diamond layers produced by embodiments described herein are recorded in Table 1 and Table 2.

In some embodiments, PDC cutter elements composed of a first polycrystalline diamond layer, and an adjacent second polycrystalline diamond layer have a lattice constant difference of less than about 10%. In some embodiments, a PDC cutter element composed of a second polycrystalline diamond layer, and an adjacent third polycrystalline diamond layer have a lattice constant difference of less than about 10%.

In some further embodiments, PDC cutter elements composed of a first polycrystalline diamond layer, and an adjacent second polycrystalline diamond layer have a lattice constant difference of less than about 5%, and in some embodiments, a PDC cutter element composed of a second polycrystalline diamond layer, and a third polycrystalline diamond layer have a lattice constant difference of less than about 5%.

Further still, in some embodiments, PDC cutter elements composed of a first polycrystalline diamond layer, and an adjacent second polycrystalline diamond layer have a lattice constant difference of less than about 3%, and in some embodiments a PDC cutter element composed of a second polycrystalline diamond layer, and a third polycrystalline diamond layer have lattice constant difference of less than about 3%.

Figure 6B:
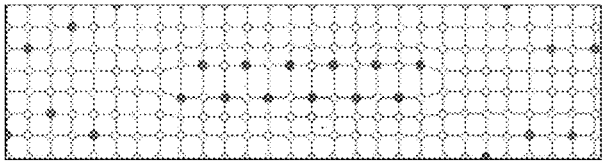
FIG. 6*b* depicts a coherent boundary showing correlated atomic positions on either side of the boundary.
Figure 6C:
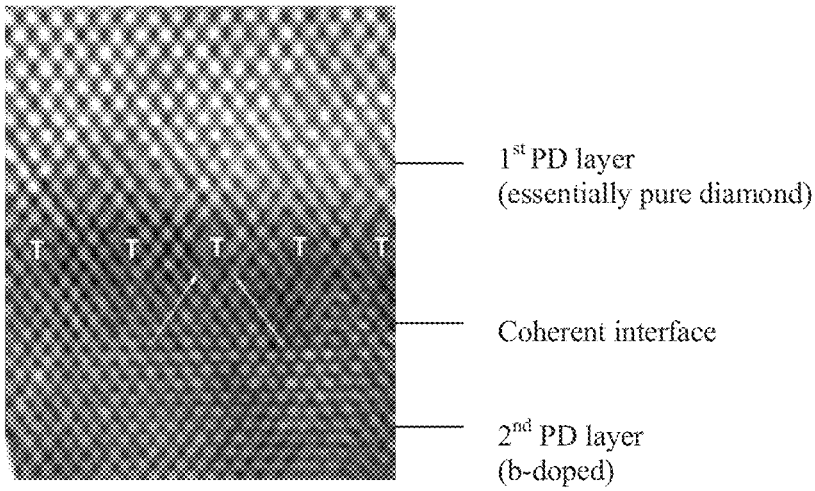
FIG. 6*c* depicts an exemplary cross-sectional view of a coherent boundary at atomic scale, for a PDC cutter element comprising a first and a second PD layer with a coherent boundary made in accordance with principles described herein.

Referring now to FIGS. 5 and 6*c*, in some embodiments, the interface that exists between the different layers of polycrystalline diamond has a coherent boundary between the two layers or phases, where a coherent boundary is defined as one for which atomic positions on either side of the boundary are correlated (see FIG. 6*b*). For example, a coherent boundary exists between a first polycrystalline diamond layer attached to a second polycrystalline diamond layer at a coherent boundary and in some embodiments a third polycrystalline layer attached to the second polycrystalline diamond layer at a second coherent boundary.

The coherent boundary is formed from small mismatches in the lattice and low interfacial energy between two different crystals, leading to no misfit dislocations along the interface as strain energy is not sufficient to overcome the activation energy required for nucleation of dislocations.

If there is a difference of less than about 10% between the lattice constants of adjacent polycrystalline diamond layers, the coherent boundary will create desirable strain fields in the lattice at the interface of about 10 to about 20 atomic layers (about 10 to about 20 lattices). This, in turn, causes elastic strain energy to build up at interface of the two layers, and increases bonding strength between the adjacent layers.

The stresses due to this condition will hamper the movement of dislocations in the material and increase its yield stress, thereby increasing the upper limit of load that can be applied to the material before plastic deformation and ultimately fracture is experienced in the crystallographic planes, thereby increasing the toughness of the PDC.

As the number of layers increase in the PDC cutter, the volume percent of coherent boundaries also increase. Any fracture or crack that does occur from impact during a drilling application will be deflected at the coherent boundary and limit the material loss, producing a microchip versus a gross fracture in the monolayer of the PDC cutter.

The abrasion resistance of PDC cutters may also be addressed by embodiments of the current invention. The abrasion resistance of PDC cutter elements is directly related to the particle size of the diamond feedstock used. Abrasion resistance increases as the diamond particle size decreases, and decreases as the diamond particle size increases. Abrasion resistance is also affected by the presence of metals used as diamond catalyzing elements (e.g., cobalt, nickel, iron, etc). In general, the abrasion resistance of PDC elements decreases as the catalyzing metal content in the PDC elements increases. Similarly, the impact resistance of PDC cutter elements is directly related to the particle size of the diamond feedstock used, whereby the impact resistance is inversely related to the abrasion resistance. Impact resistance may also be affected by small quantities of catalyzing metals which tend to increase the PDC's impact resistance, as long as the metal content is within limits needed to obtain diamond-to-diamond-bonding.

Therefore, in some embodiments of the cutter element, the first layer has a first particle size; the second layer has a second particle size whereby the second particle size is different than the first particle size. In some further embodiments, the cutter elements include a third layer having a third particle size, where the third particle size is different from the second particle size.

In some further embodiments, the first layer has a first particle size of about 1 μm to about 100 μM, preferably 5 μm to 50 μm, more preferably 8 μm to 40 μm and most preferably 15 μm to 25 μm. In some embodiments of the cutter, the second layer has a second particle size of about 25 nM to about 100 μM, preferably 50 nm to 30 μm, more preferably 100 nm to 20 μm, and most preferably 200 nm to 15 μm, and in some embodiments the optional third layer has a third particle size of about 25 nM to about 100 μM, preferably 100 nm to 20 μm, more preferably 100 nm to 10 μm, and most preferably 100 nm to 5 μm. However PDC cutter elements may be composed of N number of layers, having N−1 coherent boundaries. (FIG. 5).

Selecting appropriate diamond grain size in each of the described layers thus allows for the creation of cutting elements with a specific mechanical function. For example, the cutter element may therefore be optimized for increased abrasion resistance and increased impact resistance by selecting a small diamond grain for the cutting edge (third PD layer, FIG. 5), whilst selecting a larger grain for the layer adjacent to the substrate (first PD layer, FIG. 5). The selection of a larger diamond grain size for the PD layer which is positioned adjacent to the substrate increases the degree of binding of the PD layer to the substrate through an increased non-planer surface area, thereby decreasing the likelihood of delamination, whilst increasing impact resistance.

The ability to select desirable properties for the final PDC cutter element by choosing the appropriate diamond for each layer is not limited to the size of the diamond grain, but also the chemical diversity of the modified diamond of that layer. Properties that can be controlled by modifying the chemical content of the diamond include, but are not limited to: electrical conductivity, strength, optical properties and thermal stability. Therefore, in some embodiments, the cutter element has at least one layer that is doped with a dopant; wherein the dopant is selected from the group comprising: Al, B, N, Li, K, Ti, P, and Zr, or combinations thereof.

In further embodiments, a layer is doped in an amount of about 10 atomic percent to about 0.001 atomic percent of the dopant, in further embodiments the layer is doped in an amount of about 1 atomic percent to about 0.01 atomic percent of the dopant. In a further embodiment, the layer is doped with B (boron), and in a still further, embodiment the dopant, B is in an amount of less than about 0.5 atomic percent. Whereby the atomic percent is defined as the percentage of dopant relative to the total number of atoms (carbon, hydrogen and dopant).

Boron doped diamonds can also be used as the superabrasive particles and are potentially superior in terms of thermal stability compared to non-boron doped diamonds. Boron has P-type semi-conductive properties, whereby its valence electron deficiency allows boron to accept electrons creating "positive holes" in the lattice, while Phosphorus (P) doped diamond has N-type semi-conductive properties. Therefore, in some embodiments, PDC cutters have increased conductivity and increased thermal stability in comparison to non-boron doped PDC cutter elements. In some further embodiments, PD layers have an increased conductance compared to undoped diamond. In further embodiments, the PD layers have an increased thermal stability compared to undoped diamond N-type and P-type semi-conductor diamond can be used as distinct layers because their lattice constants are different from that of pure diamond.

Figure 7A:
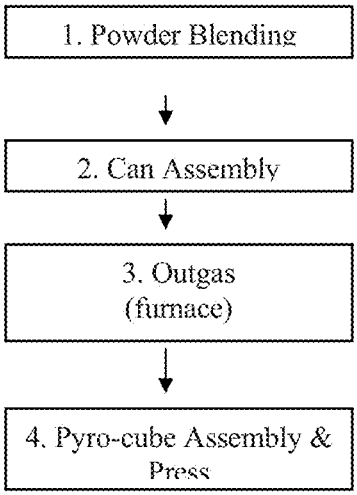
FIG. 7*a* depicts a process flow chart representing a first method for making a PDC cutter, whereby doped diamonds are produced in-situ, in accordance with principles described herein.
Figure 7B:
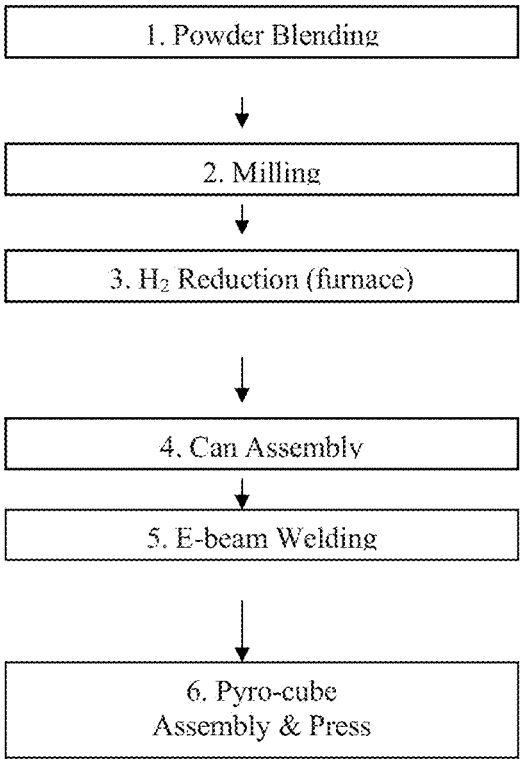
FIG. 7*b* depicts a process flow chart representing a second method for making a PDC cutter in accordance with principles described herein.
Figure 8A:
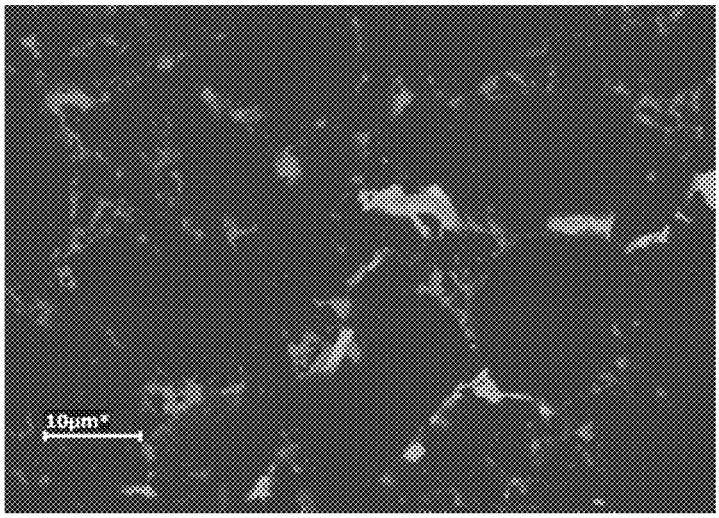
FIG. 8*a* is a scanning electron microscope backscattering spectroscopic image of an essentially pure polycrystalline diamond layer (20 μm diamond particles+100 nm diamond powder) made in accordance with principles described herein.
Figure 8B:
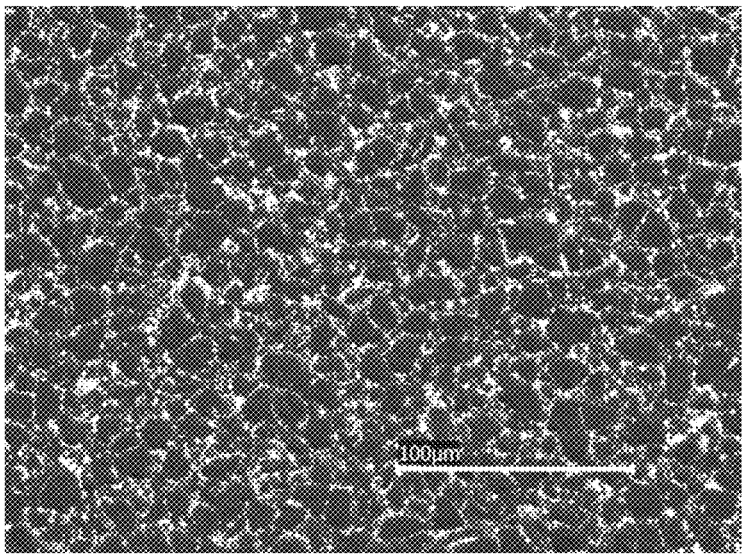
FIG. 8*b* is a scanning electron microscope backscattering spectroscopic image of an in-situ boron-doped diamond second layer (22 μm diamond particles+Ni-4.5Si-3B) made in accordance with principles described herein.
Figure 9A:
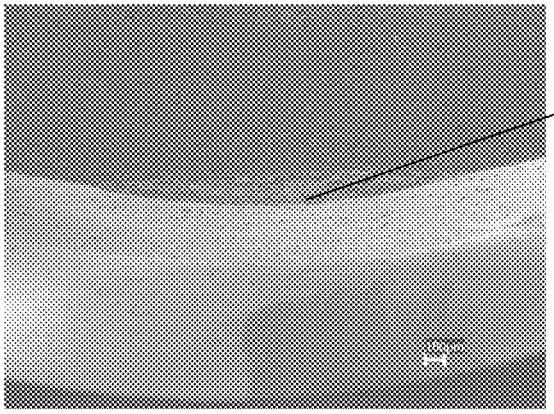
FIG. 9*a* is a scanning electron microscope backscattering spectroscopic image of a boron-doped PDC cutter element after laboratory interrupted cutting tests. The element is made in accordance with principles described herein.
Figure 9B:
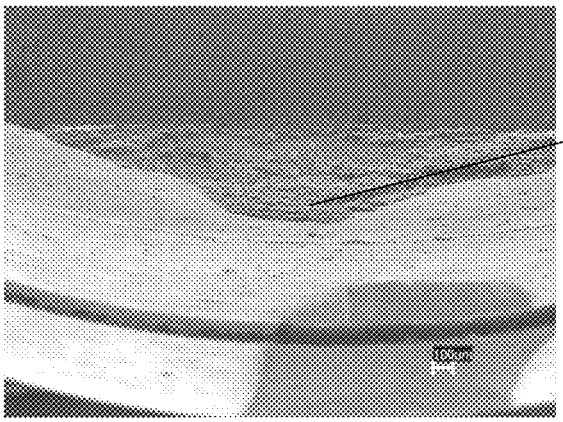
FIG. 9*b* is a scanning electron microscope backscattering spectroscopic image of an un-doped PDC cutter element made by conventional methods.

In laboratory interrupted cutting tests, under high heat generation and high impact, an embodiment of a boron doped PDC cutter (FIG. 9*a*) out performed a conventional undoped PDC cutter (FIG. 9*b*), whereby greater damage to the cutter element surface is apparent in the undoped conventional cutter. Similarly, in a casing drilling test the boron doped PDC cutter again out performed a conventional undoped PDC cutter In some embodiments, the method of introducing the dopant into the polycrystalline diamond cutter may include, but is not limited to, conventional methods, where by preformed doped diamond powder is used (FIG. 7*b*). Further, in some embodiments, in-situ techniques such as chemical vapor deposition methods may be used. Whereby, for example, adding small amounts of a boron source such as biborane ($B_2H_6$) to the diamond feed gas (comprising a hydrogen/hydrocarbon mixture) in the desired atom percent will yield a B-doped polycrystalline diamond layer. In some embodiments, solid state liquid diffusion methods (FIG. 7*a*) maybe used, whereby utilizing a metal alloy such as Ni-4.5 Si-3B for liquid diffusion, will result in the formation of the desired B-doped polycrystalline diamond layer as depicted in FIG. 8*b*. The incorporation of dopant into the diamond, such as by substitution of an $SP^3$ carbon, results in the desired change in lattice constant for the doped species in comparison to the non-doped diamond (Table 1 and Table 2).

One exemplary method of making a cutter element for a drill bit, comprises: (a) loading a container with a first volume of polycrystalline diamond material with a first lattice constant; (b) loading the container with at a second volume of polycrystalline diamond material with a second lattice constant after (a), wherein said second lattice constant is different from said first lattice constant; (c) loading a volume of a substrate material after (b); (d) sintering each said volume of material by applying high temperature and high pressure and forming a first coherent boundary between said first volume and said second volume.

In other embodiments, a method of making a cutter element comprises the steps described in the preceding paragraph, as well as: loading said container with at a third volume of polycrystalline diamond material with a third lattice constant that is different from said second lattice constant after (b) and before (c); and forming a second coherent boundary between said second volume and said third volume.

In some embodiments, high temperature is a temperature greater than about 1200 K and in some further embodiment's high pressure is a pressure greater than about 7 Gpa. These conditions allow the formation of a polycrystalline diamond layer that is more diamond-dense, i.e. has a greater proportion of direct diamond to diamond interaction and the presence of less metal catalyst as compared to PDC formed under the conventional temperatures and pressures. In other embodiments, said loading is by chemical vapor deposition. The following examples of processing conditions and parameters are given for the purpose of illustrating certain exemplary embodiments of the present invention.

EXAMPLES

Example 1

Production of an In Situ Boron Doped PDC Cutter

A PDC cutter element was produced by the methods described herein. A first volume of essentially pure polycrystalline diamond with a particle size of 20 μm and a fine powder of essentially pure polycrystalline diamond of 100 nm were loaded in a can to form what will become the first (outermost) layer and will comprise the cutting edge of the PDC cutting element. A second PD layer is formed by an in-situ solid state liquid diffusion method, whereby a boron doped polycrystalline diamond layer is loaded in the can. Substrate material is then loaded, and the can pressed under high temperature and high pressure conditions to form the PDC cutter element. (FIG. 7*a*).

The first essentially pure polycrystalline diamond layer has a lattice constant of 3.5543 Å, whilst the boron-doped polycrystalline diamond layer has a lattice constant of 3.6306 Å, a difference of about 4% (Table 1). This difference allowed the formation of a coherent boundary between the two layers observed in the x-ray diffraction pattern of FIG. 6*c*.

The resultant PDC cutter element is believed to have a number of desired properties such as an increase in impact resistance as compared to some conventional PDC cutter elements. Elemental micrographs of the surface of the cutting edge or outermost layer displays a diamond dense structure with a reduced cobalt content, whereby the cutting edge will likely be, less prone to heat damage and more resistant to abrasion as compared to some conventional PDC cutter elements. The inclusion of the B-doped layer is also believed to increase the thermal conductivity and thermal stability compared to some undoped conventional PDC cutters.

TABLE 1

Lattice Constants for PD Layers of PDC cutter element described in Example 1

| Layer | Chemical Composition | Lattice Parameter Å {1, 1, 1} | Lattice Constant Å |
|---|---|---|---|
| Control | Std. Diamond | 2.060 | 3.5667 |
| 1st Layer PD | 20 μm diamond 100 nm diamond powder | 2.0521 | 3.5543 (−0.34%) |
| 2nd Layer PD | 22 μm diamond & Ni-4.5 SI-3B | 2.0961 | 3.6306.79%) |

Further examples of measured lattice constants for doped and undoped polycrystalline diamond layers made by embodiments described herein are displayed in Table 2.

TABLE 2

Lattice Constants of PD Layers made in accordance with embodiments described herein

| PDC Layer | Particle Size (μm) | Catalyst | Doped species | B conc. Atom/cm$^3$ | Lattice spacing $d_{111}$, Å | Lattice Constant, Å | Lattice Constant Difference Compared to Pure Single Crystal Diamond, (%) | Lattice Constant Difference Compared to Pure Single Crystal Diamond, (%) |
|---|---|---|---|---|---|---|---|---|
| 1 | 20-50 | Co | | | 2.0625 | 3.5724 | +0.159 | +0.159 |
| 2 | 22-36 | Co | | | 2.0521 | 3.5543 | −0.348 | −0.348 |
| 3 | 20 | Co | B | ~$2 \times 10^{20}$ | 2.0543 | 3.55815 | −0.240 | −0.240 |
| 4 | 20 | Co | B | ~$2 \times 10^{20}$ | 2.0554 | 3.56006 | −0.186 | −0.186 |
| 5 | 28 | Co | B | ~$2 \times 10^{20}$ | 2.0583 | 3.5651 | −0.045 | −0.045 |
| 6 | 8-10 | Ni, Co, Cr | B | <$4.88 \times 10^{19}$ | 2.0459 | 3.54360 | −0.646 | −0.646 |
| 7 | 8-10 | Ni, Co | B | $1.459 \times 10^{20}$ | 2.0593 | 3.56681 | +0.003 | +0.003 |
| 8 | 8-36 | Ni, Co | B | $1.459 \times 10^{20}$ | 2.0452 | 3.54239 | −0.682 | −0.682 |

While preferred embodiments have been shown and described, modifications thereof can be made by one skilled in the art without departing from the scope or teachings herein. The embodiments described herein are exemplary only and are not limiting. Many variations and modifications of the methods and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A cutter element for a drill bit, comprising:

a substrate having a longitudinal axis;

a first layer of polycrystalline diamond coupled to the substrate; and a second layer of polycrystalline diamond coupled to the first layer at a first coherent boundary, wherein the first layer has a first lattice constant and the second layer has a second lattice constant that is different from the first lattice constant, wherein the difference between the first lattice constant and the second lattice constant is less than 10%;

wherein the first layer is axially positioned between the substrate and the second layer.

2. The cutter element of claim 1, further comprising a third layer of polycrystalline diamond attached to the second layer at a second coherent boundary; wherein the second layer is axially positioned between the first layer and the third layer.

3. The cutter element of claim 2, wherein said third layer has a third lattice constant, wherein the third lattice constant is different from the second lattice constant.

4. The cutter element of claim 3, wherein the difference between the second and the third lattice constant is less than 10%.

5. The cutter element of claim 2, wherein the third layer has a third particle size; whereby the third particle size is different from the second particle size.

6. The cutter element of claim 2, wherein at least one of the first layer and the second layer is doped with a dopent selected from the group consisting of Al, B, N, Ti, P, and Zr.

7. The cutter element of claim 6, wherein the at least one of the first layer and the second layer is doped in an amount of about0.01 atomic percent to about 10 atomic percent of said dopant.

8. The cutter element of claim 6, wherein the at least one of the first layer and the second layer is doped with B.

9. The cutter element of claim 8, wherein B is in an amount of less than about 0.5 atomic percent.

10. The cutter element of claim 1, wherein the first layer has a first particle size; the second layer has a second particle size; whereby the second particle size is different from the first particle size.

11. The cutter element of claim 1, wherein at least one of the first layer and the second layer is doped with a dopent selected from the group consisting of Al, B, N, Ti, P, and Zr.

12. The cutter element of claim 11, wherein the at least one of the first layer and the second layer is doped in an amount of about 0.01 atomic percent to about 10 atomic percent of said dopant.

13. The cutter element of claim 11, wherein the at least one of the first layer and the second layer is doped with B.

14. The cutter element of claim 13, wherein B is in an amount of less than about 0.5 atomic percent.

15. A method of applying polycrystalline diamond layers on a substrate, comprising:

(a) loading a container with a first volume of polycrystalline diamond material with a first lattice constant;

(b) loading the container with at a second volume of polycrystalline diamond material with a second lattice constant, after (a), wherein said second lattice constant is different from said first lattice constant;

(c) loading a volume of a substrate material after (b);

(d) sintering each said volume of material by applying high temperature and high pressure; and (e) forming a first coherent boundary between said first volume and said second volume, wherein the difference between the first lattice constant and the second lattice constant at the first boundary is less than10%.

16. The method of claim 15, further comprising: loading said container with a third volume of polycrystalline diamond material with a third lattice constant, after (b) and before (c), wherein said third lattice constant is different to said second lattice constant; and forming a second coherent boundary between said second volume and said third volume.

17. The method of claim 16, further comprising in-situ doping the first volume of polycrystalline diamond or the second volume of polycrystalline diamond during said loading.

18. The method of claim 16, further comprising in-situ doping the first volume of polycrystalline diamond or the second volume of polycrystalline diamond by solid state diffusion.

19. The method of claim 15, further comprising in-situ doping the first volume of polycrystalline diamond or the second or the second volume of polycrystalline diamond via chemical vapor deposition during said loading.

20. The method of claim 15, further comprising in-situ doping the first volume of polycrystalline diamond or the second volume of polycrystalline diamond by solid state liquid diffusion.

21. A drill bit for drilling a borehole in earthen formations, the bit comprising:

a plurality of cutter elements mounted on the bit, wherein said cutter elements comprise:

a substrate having a longitudinal axis;

a first layer of polycrystalline diamond coupled to the substrate;

a second layer of polycrystalline diamond coupled to said first layer at a first coherent boundary, wherein the first layer has a first lattice constant and the second layer has a second lattice constant that is different from the first lattice constant, wherein the difference between the first lattice constant and the second lattice constant is less than 10%;

wherein the first layer is axially positioned between the substrate and the second layer.

22. The drill bit of claim 21, wherein said cutter elements further comprise a third layer of polycrystalline diamond coupled to the second layer at a second coherent boundary; wherein the second layer is axially positioned between the first layer and the third layer;

wherein the third layer has a third lattice constant that is different from the second lattice constant, wherein the difference between the third lattice constant and the second lattice constant is less than 10%.

* * * * *